United States Patent [19]

Keller

[11] Patent Number: 4,875,606

[45] Date of Patent: Oct. 24, 1989

[54] REFRACTORY VALVE BODY AND SLIDING CLOSURE UNIT INCORPORATING THE SAME

[75] Inventor: Werner Keller, Steinhausen, Switzerland

[73] Assignee: Stopinc Aktiengesellschaft, Baar, Switzerland

[21] Appl. No.: 717,295

[22] Filed: Mar. 28, 1985

[30] Foreign Application Priority Data

Apr. 13, 1984 [CH] Switzerland ..... 1858/84

[51] Int. Cl.[4] ..... B67D 3/00; B22D 41/08

[52] U.S. Cl. ..... 222/600; 222/597; 222/598

[58] Field of Search ..... 222/597, 598, 599, 600, 222/591, 561; 266/236, 266, 271; 251/212, 326; 137/468; 403/30, 28

[56] References Cited

U.S. PATENT DOCUMENTS

| | | | |
|---|---|---|---|
| 4,199,087 | 4/1980 | Golas et al. | 222/600 X |
| 4,219,188 | 8/1980 | Meier | 222/603 X |
| 4,314,659 | 2/1982 | Shapland | 222/598 X |
| 4,447,966 | 5/1984 | Mollenkopf et al. | 403/28 X |
| 4,540,304 | 9/1985 | Pavelka et al. | 403/28 X |
| 4,564,232 | 1/1986 | Fujimori et al. | 403/30 X |

FOREIGN PATENT DOCUMENTS

| | | |
|---|---|---|
| 0040340 | 5/1981 | European Pat. Off. . |
| 2821839 | 11/1979 | Fed. Rep. of Germany . |
| 3013975 | 12/1980 | Fed. Rep. of Germany . |

*Primary Examiner*—Joseph J. Rolla

*Attorney, Agent, or Firm*—Wenderoth, Lind & Ponack

[57] ABSTRACT

Stationary and sliding refractory valve bodies of a sliding closure unit, for use in controlling the discharge of molten material from a vessel, are mounted on respective support frames to be precisely centered with respect thereto and to prevent the application to the refractory valve bodies of stresses due to such mounting during operation of the unit. At least one bore hole and at least one elongated groove are formed in the refractory valve body. First and second rods are fixed to the respective support frame and extend therefrom into the bore hole and the groove, respectively. The bore hole is centered on a longitudinal axis of the groove extending in the direction of elongation thereof.

39 Claims, 3 Drawing Sheets

REFRACTORY VALVE BODY AND SLIDING CLOSURE UNIT INCORPORATING THE SAME

BACKGROUND OF THE INVENTION

The present invention relates to a slide gate nozzle or sliding closure unit for controlling the discharge of molten material from a vessel, such unit being of the type including stationary and sliding refractory valve bodies, such as plate shaped members, supported in respective support frames with lateral play or clearance between each refractory valve body and the respective support frame, and the refractory valve bodies having complementary abutting relative sliding surfaces.

The present invention furthermore relates to a refractory valve body usable as a stationary or sliding valve member in such slide gate nozzle or sliding closure unit.

A sliding closure unit of the above type is disclosed in DE-A1 28 21 839, wherein a refractory valve body inserted in a support frame with lateral play is tightened and centered by at least one eccentric which is removably held to the support frame and the eccentric surface of which acts on a metal jacket surrounding the refractory valve body. The valve body is tightened in the support frame by means of a rotary tool operating on the eccentric. This arrangement however produces pressure and binding stresses on the refractory valve body, especially when it is in a heated condition during use. This leads to the substantial disadvantage of cracking of the valve body and thus to reduced service life thereof. Since the valve bodies generally are manufactured with rather large tolerances relating to circumferential or peripheral dimensions, it often will occur that valve bodies are formed with dimensions near the lower limit of such tolerance. When this occurs, the eccentrics will not be able to exert tension on the valve bodies when mounting them in the support frames. A further disadvantage of this arrangement is the fact that it is not possible to precisely center the valve bodies with respect to the support frames.

Another sliding closure unit of this general type is disclosed in EP-A1 0 040 340, wherein refractory valve bodies are clamped between two support frame parts by means of screws or bolts. Holes or slots are provided in the frame parts to enable the insertion of dowels attached to the support frame. The valve bodies are in the form of generally rectangular plates and are held at all corners thereof by the dowels. A disadvantage of this arrangement is the fact that the refractory plates, which expand substantially during operation as a result of being heated, also are exposed to additional pressure and binding stresses, thereby provided a negative effect on the service life of the refractory plates. In addition, the refractory plates must be manufactured with precise tolerances on the lateral sides thereof so that they can be properly inserted together with the frame parts into the respective support frame.

SUMMARY OF THE INVENTION

With the above discussion in mind, it is an object of the present invention to provide an improved sliding closure unit of the above described type, and a refractory valve body which may be employed as a stationary and/or slidable valve member thereof, whereby the above and other prior art disadvantages are overcome.

It is a further object of the present invention to provide such a valve body which may be easily and economically produced.

It is a yet further object of the present invention to provide an arrangement for mounting such a valve body in a respective support frame in a precisely centered manner and such that the refractory valve body will not be exposed during operation of the sliding closure unit to pressure and binding stresses as a result of the mounting and connection to the support frame.

These objects are achieved in accordance with the present invention by the provision, in at least one refractory valve body, particularly a plate shaped refractory member, of at least one bore hole and at least one elongated groove, the bore hole being centered on a longitudinal axis of the groove extending in the direction of elongation thereof. Rods are fixed to the respective support frame and extend therefrom into the bore hole and into the groove. By this arrangement, it is possible for the refractory valve bodies to be easily inserted into the respective support frames. The occurrence of pressure and binding stresses during operation of the unit are avoided, since the valve bodies are allowed to expand in all directions without resistance. In other words, each valve body is precisely positioned within a respective support frame, with lateral play or clearance therebetween, in a manner such that upon heating of the valve body during use of the sliding closure unit, the valve body is allowed to expand in all directions without being subjected to binding stresses.

In a preferred arrangement of the present invention, both the stationary and sliding refractory valve bodies are mounted in their respective support frames in this manner. In such arrangement, one rod of the stationary support frame extends into the bore hole of the stationary refractory valve body with a snug fit therebetween, thereby retaining the stationary valve body in such support frame upon opening of the sliding closure unit during disassembly thereof.

It also is possible to provide that one rod extends into the bore hole with a slight play therebetween, and the other rod extends into the groove with substantial play therebetween in the directions of the axis of elongation of the groove and with slight therebetween in directions transverse to such axis. This arrangement further reduces the chance of stresses being imparted to the valve bodies during expansion thereof. Those skilled in the art will understand the relative dimensions involved in providing such slight and substantial play for a given installation, based on factors such as expansion characteristics of the particular refractory material involved, the sizes of the bore hole and groove, the temperatures encountered with the particular molten material, etc.

The present invention is applicable both to linear sliding closure units, wherein the refractory valve bodies generally are in the form of rectangular shaped plates, and rotary sliding closure units, wherein the valve bodies generally are in the form of circular plates. The grooves may be in the form of open-ended slots which open laterally onto an edge of the respective valve bodies. The bore holes and grooves may extend entirely through the respective refractory plates, thus increasing service life thereof. Alternatively, the bore holes and grooves may be formed as blind holes, whereby the complementary abutting relative sliding surfaces of two refractory bodies are not interrupted, thus reducing wear on such surfaces.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 2:
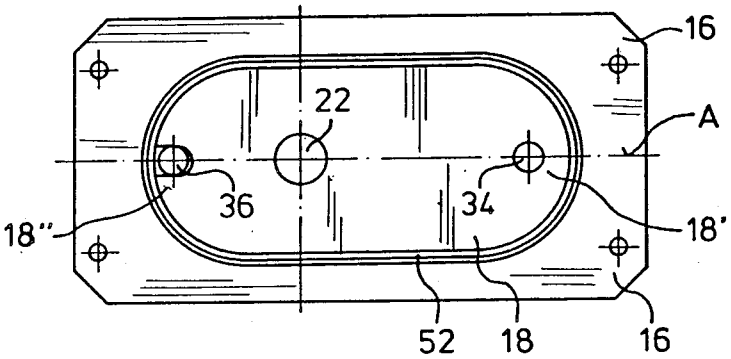
FIG. 2 is a schematic view from the bottom of the assembly of the stationary refractory plate and the support frame thereof shown in FIG. 1.
Figure 1:
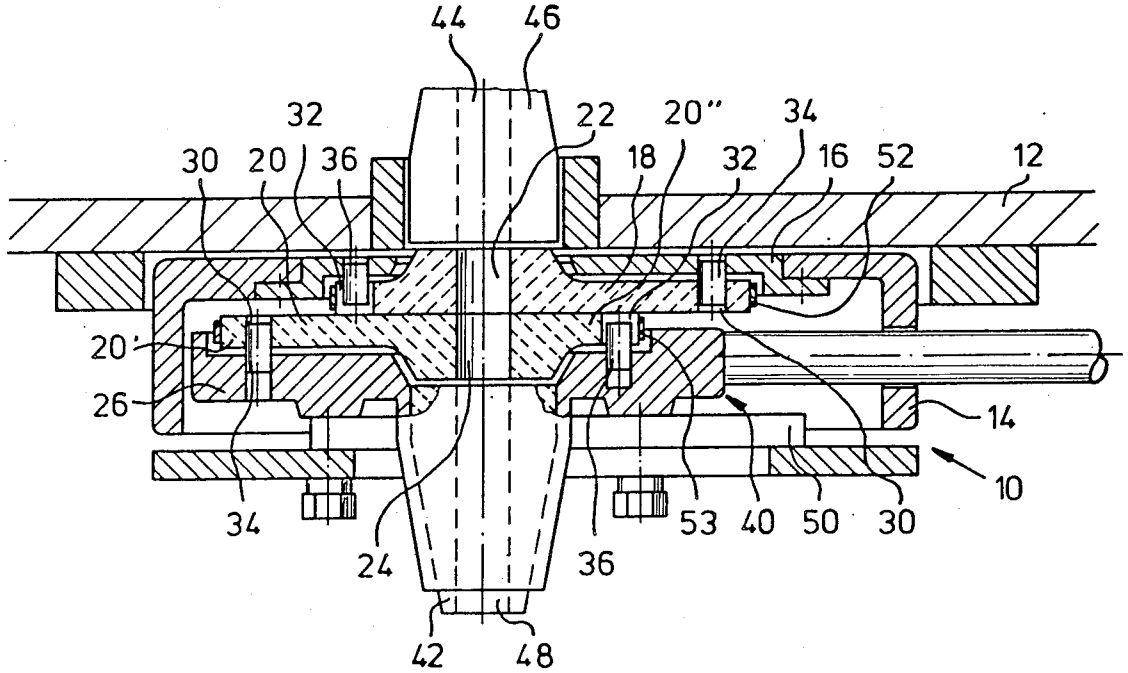
FIG. 1 is a vertical axial section through a linear sliding closure unit according to the present invention.

FIGS. 1 and 2 show a linear slide gate nozzle or sliding closure unit 10 mounted to a bottom 12 of a vessel containing molten material, for example a steel casting or pouring vessel. Unit 10 includes a slide unit housing 14 to which is attached, for example by bolts, a stationary support frame 16. Mounted within frame 16 is an upper, stationary refractory valve body 18, generally plate-shaped as shown and having a flow-through or discharge opening 22 in alignment with an outlet opening 44 of a nozzle brick 46 mounted within bottom 12 of the container. A lower, sliding refractory valve body 20, generally plate-shaped as shown, is mounted within a movable support frame 26 of a slide carriage 40. Refractory valve bodies or plates 18, 20 have complementary abutting relative sliding surfaces and are positioned within the respective support frames 16, 26 with lateral clearance or play of a few millimeters therebetween, as will be understood by those skilled in the art. Slide carriage 40 is movable along tracks 50 in opposite linear directions by means of a hydraulic mechanism (not shown) to move sliding refractory plate 26 between an open discharge position shown in FIG. 1, whereat discharge opening 24 of refractory plate 20 aligns with discharge opening 22 of stationary refractory plate 18, and a closed position, whereat discharge openings 22, 24 are not aligned. An outlet nozzle 42 having a discharge opening 48 may be mounted within frame 26 in a manner known in the art.

In accordance with the present invention, the refractory plates 18, 20 are mounted in respective support frames 16, 26 in a manner to be precisely centered with respect thereto, while preventing the application to the refractory plates of pressure and binding stresses due to such mounting during the operation of the unit, i.e. upon thermal expansion of the refractory plates. Thus, at least one of plates 18, 20 is provided with a bore hole 30 and a groove 32. In the illustrated arrangement, both of plates 18, 20 include respective bore holes 30 and grooves 32. First and second bolts or rods 34, 36 are fixed to respective support frames 16, 26 and extend therefrom into the bore holes 30 and grooves 32, respectively, of the respective refractory plates. Rods 34, 36 may be pressed into bore holes formed in the support frames 16, 26. In accordance with the present invention, and as shown particularly in FIG. 2, bore hole 30 is centered on a longitudinal axis A of groove 32 extending in the direction of elongation thereof. Further as shown in FIG. 2, axis A defines a center axis of refractory plate 18 extending in the direction of linear movement thereof between first and second ends 18 ', 18" thereof. Thus, bore hole 30 and groove 32 are centered on the center axis of plate 18. Additionally, discharge opening 22 is centered on center axis A at a position closer to the second end 18" than to the first end 18'. Thus, the zone of the plate around bore hole 30, which is subjected to higher stress during operation, is of greater size than the less highly stressed zone around groove 32. This has a further advantageous effect on the service life of the plate.

In the illustrated arrangement of FIGS. 1 and 2, groove 32 is in the form of an open-ended slot which opens on end 18", 20" of the respective refractory plate. A metal jacket 52, 53 peripherally surrounds the respective refractory plate 18, 20 and also surrounds the open end of the respective slot-shaped groove 32 therein.

As illustrated particularly in FIG. 1, refractory plates 18 and 20 are of identical construction, but simply are rotated with respect to each other by 180° when assembled into the sliding closure unit. Such feature further reduces the cost of the assembly.

Figure 4:
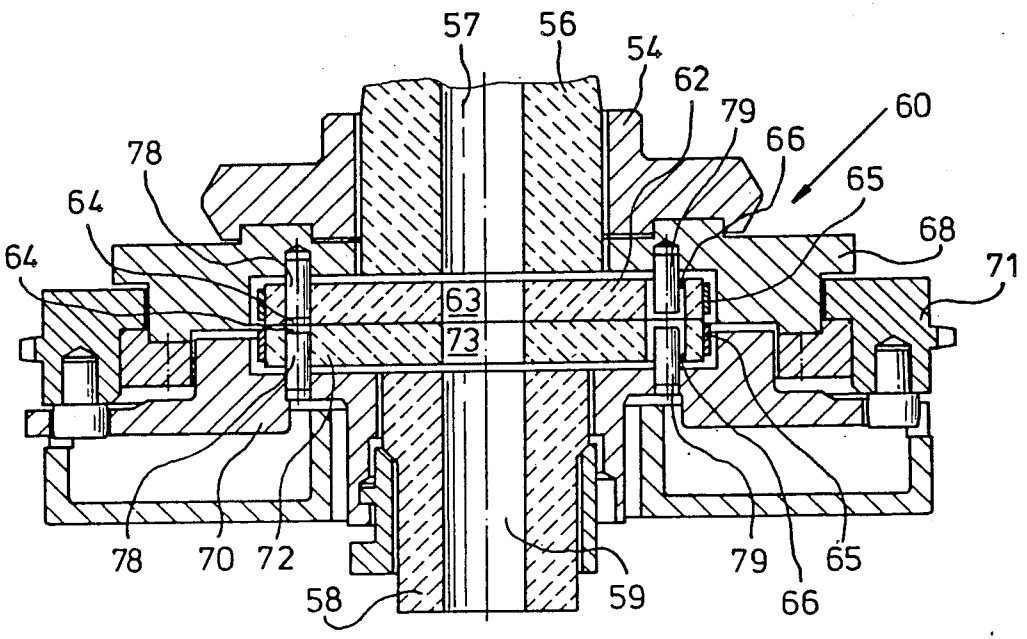
FIG. 4 is a vertical section through a rotary sliding closure unit in accordance with the present invention and taken along line IV—IV of the sliding refractory plate shown in FIG. 3.

The present invention also is applicable to a rotary slide gate nozzle or sliding closure unit such as 60 illustrated in FIG. 4. Unit 60 is intended to correspond in structure to the rotary sliding closure unit disclosed in DE-A1 30 13 975, and therefore the attached drawings and following description of the structure of such unit will be limited to those necessary for understanding the essential features of the present invention.

Thus, unit 60 includes an upper stationary refractory valve body 62 in the form of a circular plate mounted in a stationary support frame 68 which is fastened to a ring 54 to be attached to a container bottom. A lower sliding refractory valve body 72 in the form of a circular plate is mounted in a rotatable support frame 70 which is connected in a known manner, for example by a drive fastening, to a ring member 71 which is arranged concentrically, such that the rotary support frame 70 and the rotary refractory plate 72 may be rotated via a transmission by a controllable motor (not shown). Each of the refractory plates 62, 72 has a peripherally surrounding metal jacket 65 and is mounted with a clearance or play of a few millimeters in all directions with respect to the respective support frame. In the open position shown in FIG. 4, discharge opening 73 of rotatable refractory plate 72 and discharge opening 59 of a refractory discharge nozzle 58 are aligned with discharge opening 63 of stationary refractory plate 62 and outlet opening 57 of nozzle brick 56.

Figure 3:
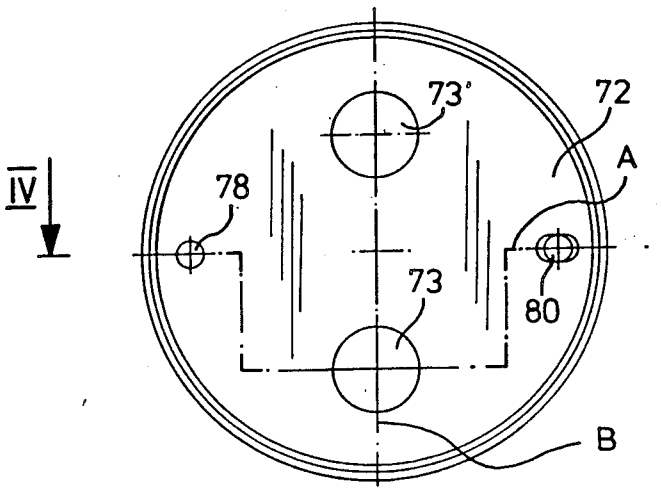
FIG. 3 is a schematic top view of a sliding refractory plate of a rotary sliding closure unit according to the present invention.

As shown in FIG. 3, the rotatable refractory plate 72 is provided with two discharge openings 73, 73' which are centered on an axis B of plate 72 and are spaced equal distances on opposite sides of the rotary center of plate 72.

At least one of plates 62, 72 has therein a bore hole 64 and a groove 66 into which fit respective bolts or rods 78, 79 which are fixed, for example by being pressed into bore holes, in the respective support frames. In the illustrated arrangement, both plates 62, 72 are mounted to the respective support frames 68, 70 in such manner.

As shown in FIG. 3, bore hole 64 is centered on an axis of elongation of the groove 66, and both bore hole 64 and groove 66 are located on an axis A of plate 72 which is transverse to or rotated 90° with respect to axis B, such that bore hole 64 and groove 66 are diametrically opposite one another near the edge or periphery of plate 72. Advantageously, bore hole 64 and groove 66 are located radially outwardly of the annular area formed by the movement of discharge openings 73, 73'.

Figure 5:
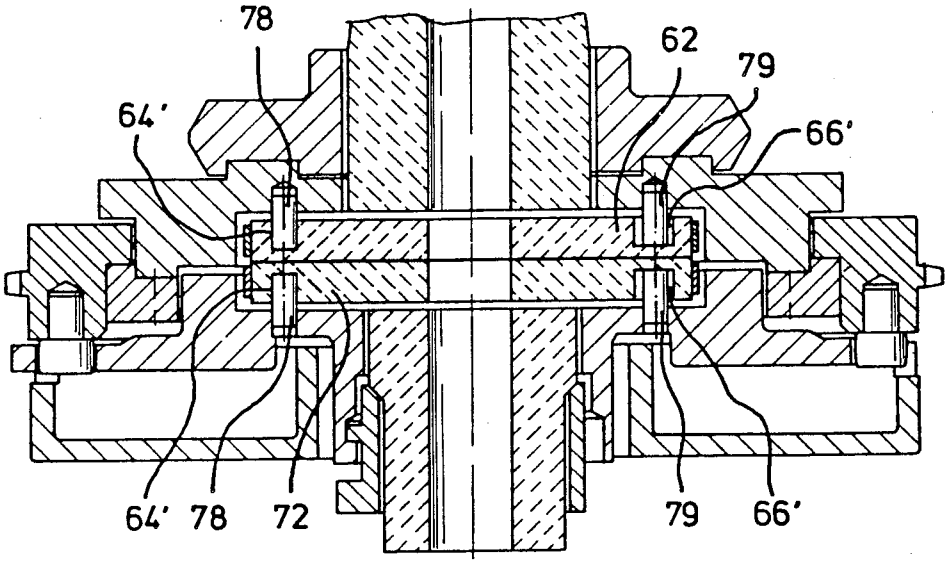
FIG. 5 is a view similar to FIG. 4, but of a modified rotary sliding closure unit and also taken along line IV—IV in FIG. 3.

The arrangements shown in FIGS. 1 and 4 feature bore holes and grooves which extend entirely through the thickness of the respective refractory plates. However, FIG. 5 illustrates a modification according to the present invention wherein bore holes 64' and grooves 66' are blind holes and extend only partially through the thickness of the respective refractory plates. The embodiment of FIG. 5 otherwise is the same as the embodiment of FIG. 4. Furthermore, this feature of the embodiment of FIG. 5 equally may be employed in a linear sliding closure unit such as shown in FIG. 1.

Figure 6:
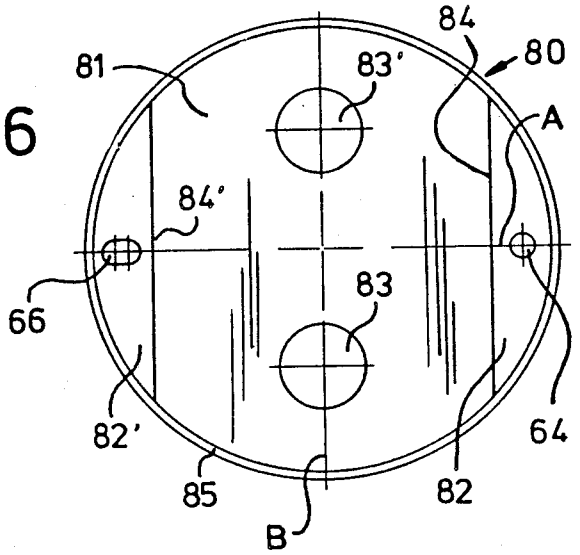
FIGS. 6 and 7 are schematic top views of two other modified sliding refractory plates for rotary sliding closure units according to the present invention.

FIG. 6 illustrates a modification of the circular refractory plates shown in FIGS. 4 and 5. Thus, the circular refractory valve body or plate 80 of FIG. 6 includes a refractory member 81 having therethrough two discharge openings 83, 83' located on axis B equally spaced on opposite sides of the rotational center of the plate assembly 80. The refractory member has parallel edge surfaces 84, 84' located at equal distances on opposite sides of axis B and extending parallel thereto. Edge surfaces 84, 84' thus define circular chords. Metal segments 82, 82' abut edge surfaces 84, 84', respectively, and are pressed thereagainst by a metal jacket 85 peripherally surrounding assembly 80. Bore hole 64 is formed in metal segment 82, and groove 66 is formed in metal segment 82'. Bore hole 64 and groove 66 are located on axis A of the refractory assembly 80 to extend transverse to or be rotated 90° with respect to axis B. Further, bore hole 64 and groove 66 are located diametrically opposite one another in a peripheral area of the assembly radially outwardly of the annular area covered by movement of the discharge openings 83, 83'. This arrangement of FIG. 6 has the additional advantage of preventing any possible strain or stress being imparted to the refractory body by the fitting of rods 78, 79 into bore hole 64 and groove 66, respectively.

Figure 7:
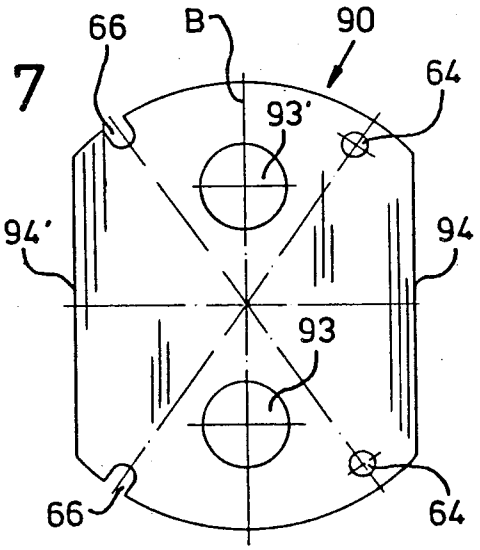

FIG. 7 illustrates another modified refractory plate 90 which may be employed in the units of FIGS. 4 or 5. Thus, refractory plate 90 may be generally in the form of a circle having a center of rotation, but also may be provided with edge surfaces 94, 94' located on opposite sides at equal distances from axis B and extending generally parallel thereto. Preferably, edge surfaces 94, 94' may be parallel chords. Refractory plate 90 has two discharge openings 93, 93' centered on axis B at equal distances on opposite sides of the center of rotation of the plate. This embodiment provides two bore holes 64 and two grooves 66 arranged in a cross-hair fashion symmetrically to axis B. In other words, one bore hole 64 and associated groove 66 are centered on one axis of the plate extending at an angle to axis B, and the other bore hole 64 and associated groove 66 are centered on a further axis extending at a similar angle to axis B. In this embodiment, preferably the grooves 66 are in the form of open-ended slots opening onto the periphery of plate 90. Further, the bore holes 64 and grooves 66 are located at peripheral edges of plate 90 other than chord surfaces 94, 94'. In this arrangement, rods 78, 79 may fit in both bore holes 64 and both grooves 66, or alternatively the rods may be fitted into only one bore hole 64 and its associated groove 66.

The rods 34, 36, 78, 79 are shown as being pressed into bore holes in the respective support frames. This fixing however could be achieved in other manners as would be apparent to one skilled in the art, for example by bolt or screw connections.

Rods 34, 78 preferably extend into respective bore holes 30, 64, 64' with a slight play, and rods 36, 79 extend into grooves 32, 66, 66' with substantial play therebetween in the directions of elongation of the grooves and with slight play in directions transverse to the direction of elongation. This makes it possible for the refractory plates to expand in the direction of the axis of elongation of the grooves without tension and expansion stress. However, the rods which extend into the bore holes in the upper, stationary refractory plate may have a snug fit. This prevents the upper stationary plate from falling outwardly when the sliding closure unit is opened during disassembly. The rods extending into the bore holes transfer displacement forces to the refractory plates, while both the rods extending into the bore holes and into the grooves together operate to ensure precise alignment and centering of the refractory plates within the respective support frames.

Constructing the refractory plates of identical configuration makes it possible to use the plates both as upper, stationary and as lower, sliding plates. Further, with regard to the plates shown in FIGS. 4 and 5, these plates may be reversed in position, i.e. turned over, to abut opposite surfaces thereof. This increases the service life of the plates. Even further, the upper, stationary refractory plates 62, 80, 90 in the rotary sliding closure units can be rotated by 180°, thereby bringing a previously nonemployed discharge opening 83, 83' into use. This even further increases the service life of such plate.

Although the present invention has been described and illustrated with respect to preferred features thereof, it is to be understood that various modifications and changes as would be apparent to one skilled in the art may be made to the described and illustrated arrangements without departing from the scope of the present invention.

I claim:

1. In a sliding closure unit for controlling the discharge of molten material from a vessel, said unit being of the type including a stationary support frame to be mounted on the vessel, a stationary refractory valve body mounted in said stationary support frame and having a discharge opening aligned with an outlet opening of the vessel, a sliding refractory valve body having therethrough a discharge opening, said stationary and sliding refractory valve bodies having complementary abutting relative sliding surfaces, and a movable support frame mounting said sliding refractory valve body for sliding movement between a discharge position, whereat said discharge opening of said sliding refractory valve body aligns with said discharge opening of said stationary refractory valve body, and a closed position, whereat said discharge openings are not aligned, the improvement of means for mounting at least one said refractory valve body on the respective said support frame in a manner centered with respect thereto while preventing application to said refractory valve body of binding stresses due to such mounting during operation of said unit, said mounting means comprising:

at least one bore hole and at least one elongated groove formed in said at least one refractory valve body;

first and second rods fixed to said respective support frame and extending therefrom into said bore hole and said groove, respectively; and said bore hole being centered on a longitudinal axis of said groove extending in the direction of elongation thereof.

2. The improvement claimed in claim 1, wherein each said refractory valve body has therein at least one said bore hole and one said groove, and each said support frame has fixed thereto said rods extending into respective said bore holes and grooves.

3. The improvement claimed in claim 2, wherein said first rod of said stationary support frame extends into said bore hole of said stationary refractory valve body with a snug fit therebetween.

4. The improvement claimed in claim 1, whereinsaid first rod extends into said bore hole with a slight play therebetween, and said second rod extends into said groove with substantial play therebetween in the directions of said axis and with slight play therebetween in directions transverse to said axis.

5. The improvement claimed in claim 1, wherein said unit is linearly movable, said at least one refractory valve body has a center axis extending in the direction of linear movement between first and second ends of said valve body, said bore hole is centered on said center axis adjacent said first end of said valve body, said groove is centered on said center axis adjacent said second end of said valve body, said discharge opening is centered on said center axis at a position closer to said second end of said valve body than said first end thereof, and said groove is in the form of a slot opening onto said second end of said valve body.

6. The improvement claimed in claim 5, further comprising a metal jacket peripherally surrounding said at least one refractory valve body and covering the open end of said slot.

7. The improvement claimed in claim 1, wherein said unit is rotatably movable, said discharge opening of said at least one refractory valve body is spaced from the center of said valve body and is centered on a first axis of said valve body passing through said center, and said bore hole and aid groove are centered on a second axis of said valve body extending transverse to said first axis and passing through said center.

8. The improvement claimed in claim 7, wherein said bore hole and said groove are located at positions on opposite sides of said center adjacent the periphery of said valve body.

9. The improvement claimed in claim 8, wherein said refractory valve body is circular.

10. The improvement claimed in claim 7, wherein said at least one refractory valve body comprises an assembly of a refractory member having parallel edge surfaces located on opposite sides of said first axis and extending parallel thereto, and first and second metal segments abutting said edge surfaces, said bore hole being in said first segment, and said groove being in said second segment.

11. The improvement claimed in claim 10, wherein said assembly is circular.

12. The improvement claimed in claim 11, further comprising a metal jacket peripherally surrounding said assembly and pressing said segments against respective said edge surfaces.

13. The improvement claimed in claim 7, wherein said at least one refractory valve body has a second discharge opening centered on said first axis at a location spaced from said center opposite the first said discharge opening.

14. The improvement claimed in claim 1, wherein said unit is rotatably movable, said discharge opening of said at least one refractory valve body is spaced from the center of said valve body and is centered on a first axis of said valve body passing through said center, said bore hole and said groove are centered on a second axis of said valve body extending at a first angle to said first axis and further comprising a second bore hole and a second groove centered on a third axis of said valve body extending at a second angle to said first axis, said first and second angles being equal, such that said bore holes and said grooves are located symmetrically of said first axis.

15. The improvement claimed in claim 14, wherein each said bore hole and the associated said groove are located at positions on opposite sides of said center adjacent the periphery of said valve body.

16. The improvement claimed in claim 14, wherein said at least one refractory valve body has edge surfaces located on opposite sides of said first axis and extending generally parallel thereto, and said bore holes and said grooves are located adjacent peripheral edges of said valve body other than said edge surfaces.

17. The improvement claimed in claim 16, wherein said edge surfaces are defined by parallel chords and are parallel to said first axis.

18. The improvement claimed in claim 14, wherein each said groove comprises a slot opening onto the periphery of said valve body.

19. The improvement claimed in claim 14, wherein said at least one refractory valve body has a second discharge opening centered on said first axis at a location spaced from said center opposite the first said discharge opening.

20. The improvement claimed in claim 1, wherein said bore hole and said groove extend entirely through the thickness of said at least one refractory valve body.

21. The improvement claimed in claim 1, wherein said bore hole and said groove are in the form of blind holes extending only partially through said at least one refractory valve body.

22. A refractory valve body for use as a stationary or as a sliding valve mamber of a sliding closure unit for controlling the discharge of molten material from a vessel, said valve body comprising:

a discharge opening for use in discharging molten material;

at least one elongated groove; and at least one bore hole centered on a longitudinal axis of said groove extending in the direction of elongation thereof, said hole being separate from and not connected to said groove.

23. A body as claimed in claim 22, having a center axis extending between first and second ends of said body, said bore hole being centered on said center axis adjacent said first end, said groove being centered on said center axis adjacent said second end, said discharge opening being centered on said center axis at a position closer to said second end than said first end, and said groove being in the form of a slot opening onto said second end of said body.

24. A body as claimed in claim 23, further comprising a metal jacket peripherally surrounding said valve body and covering the open end of said slot.

25. A body as claimed in claim 22, wherein said discharge opening is spaced from the center of said valve body and is centered on a first axis of said valve body passing through said center, and said bore hole and said groove are centered on a second axis of said valve body extending transverse to said first axis and passing through said center.

26. A body as claimed in claim 25, wherein said bore hole and said groove are located at positions on opposite sides of said center adjacent the periphery of said valve body.

27. A body as claimed in claim 26, wherein said valve body is circular.

28. A body as claimed in claim 25, wherein said valve body comprises an assembly of a refractory member having parallel edge surfaces located on opposite sides of said first axis and extending parallel thereto, and first and second metal segments abutting said edge surfaces, said bore hole being in said first segment, and said groove being in said second segment.

29. A body as claimed in claim 28, wherein said assembly is circular.

30. A body as claimed in claim 29, further comprising a metal jacket peripherally surrounding said assembly and pressing said segments a against respective said edge surfaces.

31. A body as claimed in claim 25, further comprising a second discharge opening centered on said first axis at a location spaced from said center opposite the first said discharge opening.

32. A body as claimed in claim 22, wherein said discharge opening is spaced from the center of said valve body and is centered on a first axis of said valve body passing through said center, said bore hole and said groove are centered on a second axis of said valve body extending at a first angle to said first axis, and further comprising a second bore hole and a second groove centered on a third axis of said valve body extending at a second angle to said first axis, said first and second angles being equal, such that said bore holes and said grooves are located symmetrically of said first axis.

33. A body as claimed in claim 32, wherein each said bore hole and the associated said groove are located at positions on opposite sides of said center adjacent the periphery of said valve body.

34. A body as claimed in claim 32, wherein said valve body has edge surfaces located on opposite sides of said first axis and extending generally parallel thereto, and said bore holes and said grooves are located adjacent peripheral edges of said valve body other than said edge surfaces.

35. A body as claimed in claim 34, wherein said edge surfaces are defined by parallel chords and are parallel to said first axis.

36. A body as claimed in claim 32, wherein each said groove comprises a slot opening onto the periphery of said valve body.

37. A body as claimed in claim 32, wherein said valve body has a second discharge opening centered on said first axis at a location spaced from said center opposite the first said discharge opening.

38. A body as claimed in claim 22, wherein said bore hole and said groove extend entirely through the thickness of said valve body.

39. A body as claimed in claim 22, wherein said bore hole and said groove are in the form of blind holes extending only partially through said valve body.

* * * * *